US006834776B1

(12) United States Patent
Corvese

(10) Patent No.: US 6,834,776 B1
(45) Date of Patent: Dec. 28, 2004

(54) TENNIS BALL RETRIEVING DEVICE

(75) Inventor: Lynne Corvese, 150 SE. 25th St., Apt. 8I, Miami, FL (US) 33129

(73) Assignee: Lynne Corvese, Miami, FL (US)

( * ) Notice: Subject to any disclaimer, the term of this patent is extended or adjusted under 35 U.S.C. 154(b) by 109 days.

(21) Appl. No.: 10/189,834

(22) Filed: Jul. 6, 2002

(51) Int. Cl.[7] ..... B65G 59/00
(52) U.S. Cl. ..... 221/277; 473/460
(58) Field of Search ..... 221/9, 13, 92, 221/174, 192, 191, 253, 277; 473/474, 460

(56) References Cited

U.S. PATENT DOCUMENTS 3,203,696 A * 8/1965 Sawyer ..... 473/474
5,125,654 A * 6/1992 Bruno ..... 473/460

* cited by examiner

*Primary Examiner*—Kenneth Noland

(57) ABSTRACT

The present invention 10 discloses a tennis ball retrieving apparatus wherein the tennis balls 16 roll into the gutter portion 18 of the device and an electronically controlled and powered paddle 24 moves them into a ball conveyor system 26 that dispenses the balls into a ball hopper 20. The gutter portion consists of three sections and are connected to each other by pins. A front ball stationary plate 30 which does not rotate with the conveyor wheel 54 prevents the tennis balls 16 from falling out the front side of the conveyor wheel 54 until the wheel rotates clockwise and brings the ball upward to an opening within the rear stationary plate 31 where the ball is free to fall into the ball hopper chute 32 and into the hopper 20. A digital sensor triggers the digital ball counter 34 to count the balls as they pass through the opening. An alternative embodiment is disclosed wherein the balls 16 move through the gutter 18 via gravity.

13 Claims, 12 Drawing Sheets

TENNIS BALL RETRIEVING DEVICE

BACKGROUND OF THE INVENTION

Field of the Invention

The present invention relates generally to tennis ball retrieving apparatus and, more specifically, to a lightweight, easy to transport and store tennis aid apparatus. The device of the present invention is designed to collect tennis balls and dispense them to a ball hopper. The device can be placed in the backcourt against a fence. The tennis balls roll into the gutter portion of the device and an electronically controlled paddle moves from left to right and loads one ball at a time into a conveyor system that dispenses the balls into a ball hopper.

The gutter portion of the device consists of three attaching pieces. Each piece has pins located at one distal end and mating holes at the other distal end. Each gutter section is connected to the next by the pins coupling to the provided mating hole of the next gutter portion. When the tennis balls accumulate within the gutter, an electronically controlled paddle and paddle guide moves from left to right riding within a track. As the paddle moves, it pushes the tennis balls along the track to a conveyor wheel. One ball at a time is loaded into a catch pocket within the conveyor wheel housing and conveyed upward to a shoot where the ball falls freely through an opening within the stationary plate and down the shoot into the ball hopper. When all the balls are loaded, the guide portion of the paddle hits a guide paddle sensor, the paddle reverses its course until it is time to repeat its motion.

The gutter portion consists of three sections and are connected to each other by pins. An elastic cord connects each section and is used when the gutters are disassembled, folded and stored side by side conveniently. The ball stationary plate does not rotate with the conveyor wheel and remains in a stationary position as the conveyor rotates. It prevents the tennis balls from falling out the opposite end of the conveyor wheel until the wheel brings the ball to an opening within the stationary plate where the ball is free to fall into the ball hopper shoot. A digital sensor counts the balls as they pass through the opening. A ball stop plate, located in the front portion of the conveyor wheel stops the balls from falling out on their way up to the ball hopper shoot.

The paddle motor provides a control panel and an AC/DC adapter. The conveyor motor provides a digital control panel consisting of a counter sensor located above the ball opening of the stationary plate that sends signals to the counter and displays the count on a digital display. An AC/DC adapter is provided as means to power the device.

SUMMARY OF THE PRESENT INVENTION

The present invention discloses a tennis ball retrieving apparatus wherein the tennis balls roll into the gutter portion of the device and an electronically controlled and powered paddle moves them into a ball conveyor system that dispenses the balls into a ball hopper. The gutter portion consists of three sections and are connected to each other by pins. A front ball stationary plate which does not rotate with the conveyor wheel prevents the tennis balls from falling out the front side of the conveyor wheel until the wheel rotates clockwise and brings the ball upward to an opening within the rear stationary plate where the ball is free to fall into the ball hopper chute and into the hopper. A digital sensor triggers the digital ball counter to count the balls as they pass through the opening. An alternative embodiment is disclosed wherein the balls move through the gutter via gravity.

A primary object of the present invention is to provide a device that retrieves tennis balls.

Another object of the present invention is to provide a device that retrieves tennis balls and is easy to store and transport.

Yet another object of the present invention is to provide a device that is designed to collect tennis balls and dispense them to a ball hopper.

Still yet another object of the present invention is to provide a device that is designed to collect tennis balls as they roll into the gutter portion of the device and having an electronically controlled paddle that moves from left to right and loads one ball at a time into a conveyor system that dispenses the balls into a ball hopper.

Another object of the present invention is to provide a device that is designed to collect tennis balls that consists in part of a gutter portion that includes three attaching pieces. Each piece having pins located at one distal end and mating holes at the other distal end. Each section of gutter is connected to the next by the pins coupling to the provided mating holes of the next gutter portion. Also having elastic shock cords attached to the end portions of the gutter pieces and allows for the disconnection of the gutter pieces to remain attached to each other and provide for the folding of each section of gutter for storage.

Yet another object of the present invention is to provide a tennis ball collecting device with an electronically controlled paddle and paddle guide within the housing of the gutter that moves from left to right riding within a track. The paddle pushes the tennis balls along the track to a conveyor wheel.

Still yet another object of the present invention is to provide a tennis ball-collecting device that also consists of a conveyor wheel. One ball at a time is loaded into a catch pocket within the conveyor wheel housing by the paddle and is conveyed upward to a shoot where the balls fall freely through an opening within the stationary plate and down the shoot into the ball hopper.

Additional objects of the present invention will appear as the description proceeds.

The present invention overcomes the shortcomings of the prior art by providing a device that retrieves tennis balls and is easy to store and transport. Also a device that is designed to collect tennis balls and dispenses them to a ball hopper. Also to provide a device that is designed to collect tennis balls as they roll into the gutter portion of the device and having an electronically controlled paddle that moves from left to right and loads one ball at a time into a conveyor system that dispenses the balls into a ball hopper. Also device that is designed to collect tennis balls that consists in part of a gutter portion that includes three attaching pieces. Each piece having pins located at one distal end and mating holes at the other distal end. Each section of gutter is connected to the next by the pins coupling to the provided mating holes of the next gutter portion. Also having elastic shock cords attached to the end portions of the gutter pieces and allows for the disconnection of the gutter pieces to remain attached to each other and provide for the folding of each section of gutter for storage. The device also consists of a paddle motor with control panel, a conveyor motor consisting of a digital readout display both having AC/DC adapters.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
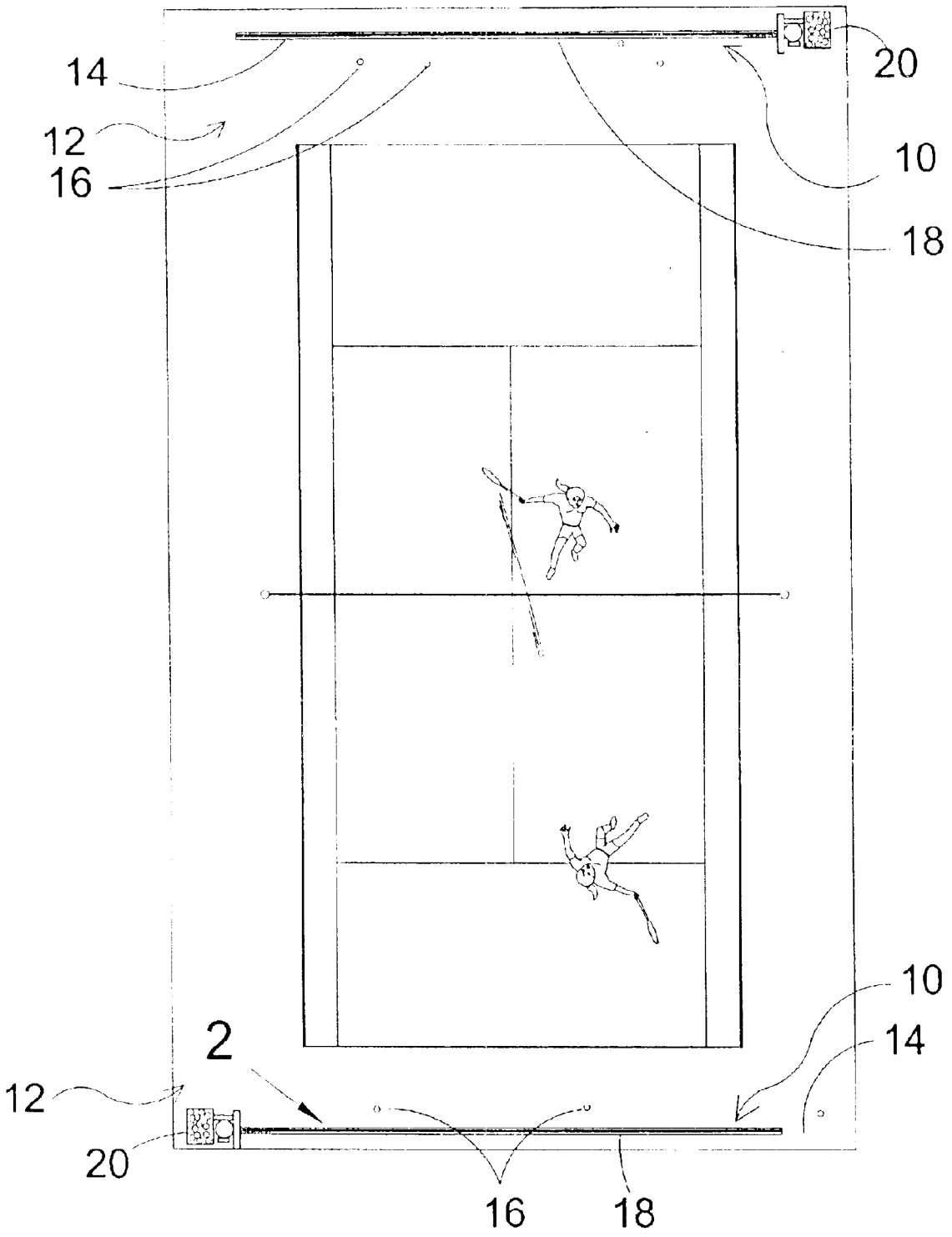
FIG. 1 is an illustrative view of the present invention in use.

With regard to reference numerals used, the following numbering is used throughout the drawings

10 present invention
12 backcourt
14 fence
16 balls
18 gutter
20 hopper
22 section of gutter
24 paddle
26 conveyor system
28 elastic cord
30 front stationary plate
31 rear stationary plate
32 chute
34 digital ball counter
36 paddle motor control
38 control panel
40 AC/DC adapter
42 conveyor motor
44 battery pack
46 paddle guide
48 track
50 gutter junction
52 relay
54 conveyor wheel
56 chute counter sensor
58 cavity
60 pivot point
62 threaded shaft
64 conveyor motor AC/DC adapter
66 conveyor motor battery pack
68 pin
70 opening
72 center lock
74 threaded hole
76 electrical track adapter
78 timer
80 AC/DC switch
82 on/off switch
84 track support ring
86 digital display
88 timer set knob
90 sensor
92 lip

DETAILED DESCRIPTION OF THE PREFERRED EMBODIMENT

The following discussion describes in detail one embodiment of the invention and at least one variation of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a lightweight, easy to transport and store tennis aid apparatus which is designed to collect tennis balls and deposit them in a ball hopper. The present invention 10 can be placed in the backcourt 12 against a fence 14 extending substantially across the tennis court. The tennis balls 16 are directed under a force to the gutter 18 having a lip for preventing the balls from rolling back out. The collection hopper 20 has a sensor for triggering an electrically controlled paddle located at the other distal end of the gutter causing the paddle to drive the balls toward the hopper. The balls are singularly fed into a conveyor that raises the balls to a height above the hopper where gravity will convey the balls into the hopper.

Figure 2:
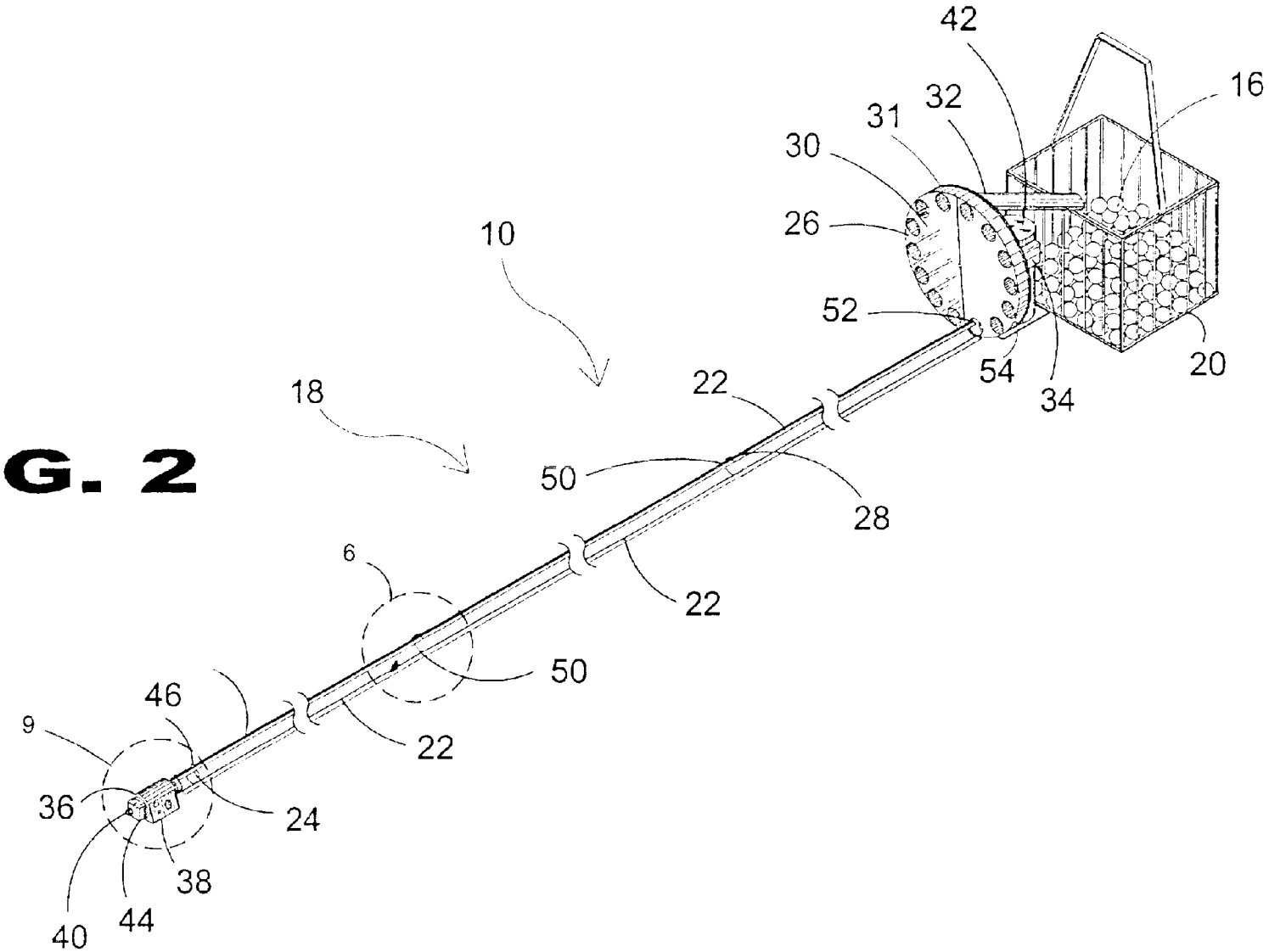
FIG. 2 is a perspective view of the present invention.

Turning to FIG. 2, shown therein is a perspective view of the present invention 10 in use. The gutter portion 18 of the device of the present invention consists of three separate connecting sections or pieces 22. Each piece 22 has pins located at one distal end and mating holes at the other distal end. Each gutter section 22 is connected to the next by the pins coupling to the provided mating holes of the opposing gutter section 22. The tennis balls 16 roll by force into the gutter portion 18 of the device and an electronically controlled paddle 24 moves from left to right and loads one ball at a time into a ball conveyor system 26 that dispenses the balls into a ball hopper 20. The gutter portion consists of three sections and are connected to each other by pins. An elastic cord 28 connects each section and is used when the gutters are disassembled, folded and stored side by side conveniently. The front ball stationary plate 30 does not rotate with the conveyor wheel 54 and remains in a stationary position as the conveyor rotates. It prevents the tennis balls 16 from falling out the front side of the conveyor wheel while the wheel rotates clockwise and brings the ball upward to an opening within the rear stationary plate 31 where the ball is free to fall into the ball hopper chute 32. A digital sensor triggers the digital ball counter 34 to count the balls as they pass through the opening. The paddle motor control 36 provides a control panel 38 and an AC/DC adapter 40. The paddle motor is a conventional linear motor means embedded in the conventional manner into the gutter sections 22 to permit the paddle 24 to be moved linearly along the gutter 18. The ball conveyor motor 42 provides another digital control panel consisting of a counter sensor located above the ball opening of the rear stationary plate 31 that sends signals to the counter 34 and displays the count on a digital display. Also shown are a motor battery pack 44, a paddle guide 46, a track 48, gutter junctions 50 and a relay 52.

Figure 3:
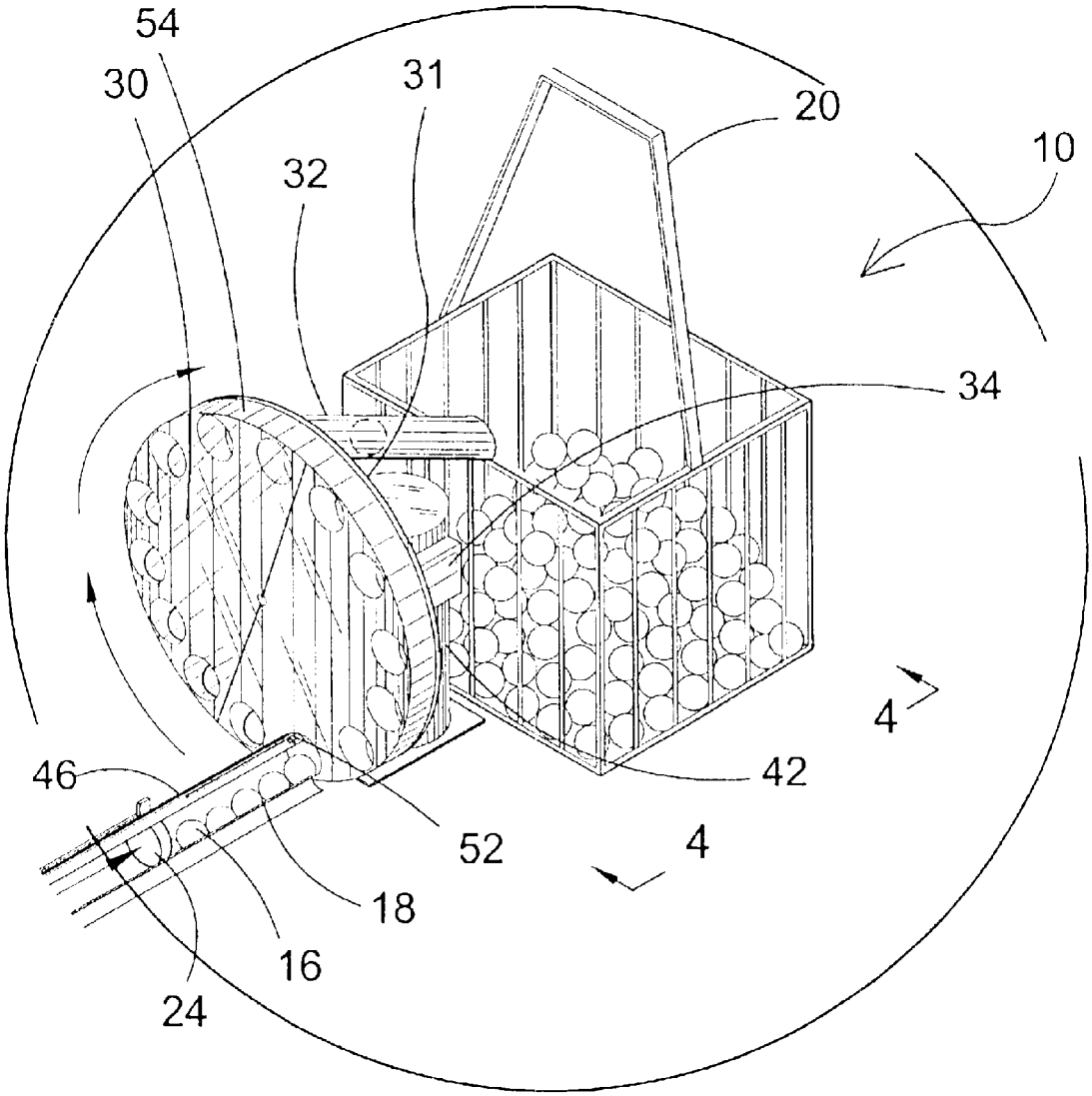
FIG. 3 is a perspective view of the present invention.

Turning to FIG. 3, shown therein is a perspective view of the present invention 10 in use. When tennis balls 16 accumulate within the gutter 18, an electronically controlled paddle 24 and paddle guide 46 moves from one distal end to the other riding within a track. As the paddle 24 moves, it pushes the tennis balls 16 along the track to a conveyor wheel 54. One ball 16 at a time is loaded into a catch pocket or cavity 58 within the conveyor wheel 54 housing and conveyed clockwise upward to an opening in a chute 32 where the ball falls freely through an opening within the stationary plate 31 and down the chute 32 into the ball hopper 20. Also shown are the sensor relay 52, conveyor motor 42 and digital ball counter 34. Also shown are the front 30 and rear 31 stationary plates.

Figure 4:
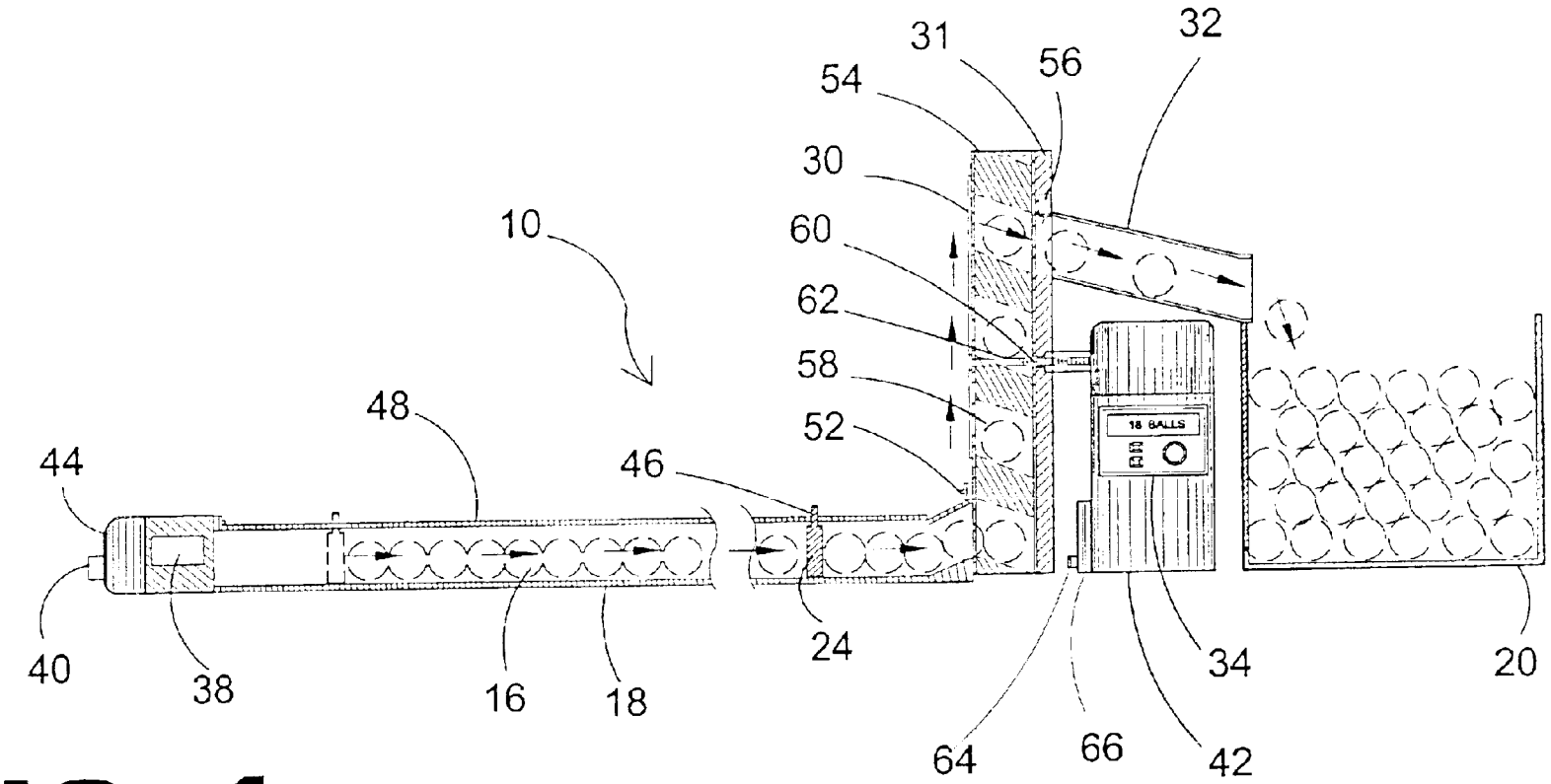
FIG. 4 is a sectional view of the present invention.

Turning to FIG. 4, shown therein is a sectional view of the present invention 10. The present invention is designed to collect tennis balls 16 and deposit them in a ball hopper 20. The tennis balls 16 roll into a multiple piece gutter 18 and an electronically controlled and operated paddle 24 and guide 46 moves them towards the ball hopper 20. The rotating conveyor wheel 54 having a plurality of cavities 58 therein carries the balls one at a time to an adjustable hinged conduit or chute 32 whereby when the conveyer aperture or cavity aligns with the aperture of the conduit 32 the ball 16 is moved by gravity into the ball hopper 20. The paddle motor control 36 provides a control panel 38 and an AC/DC adapter 40. The ball conveyor motor 42 provides another digital control panel consisting of a counter sensor 56 located above the ball opening of the rear stationary plate 31 that sends signals to the counter 34 and displays the count on a digital display and, an AC/DC adapter is provided as means to power the device which also has a battery pack 66. Also shown are a pivot point 60, and a threaded shaft 62. Other elements previously disclosed are also shown.

Figure 5:
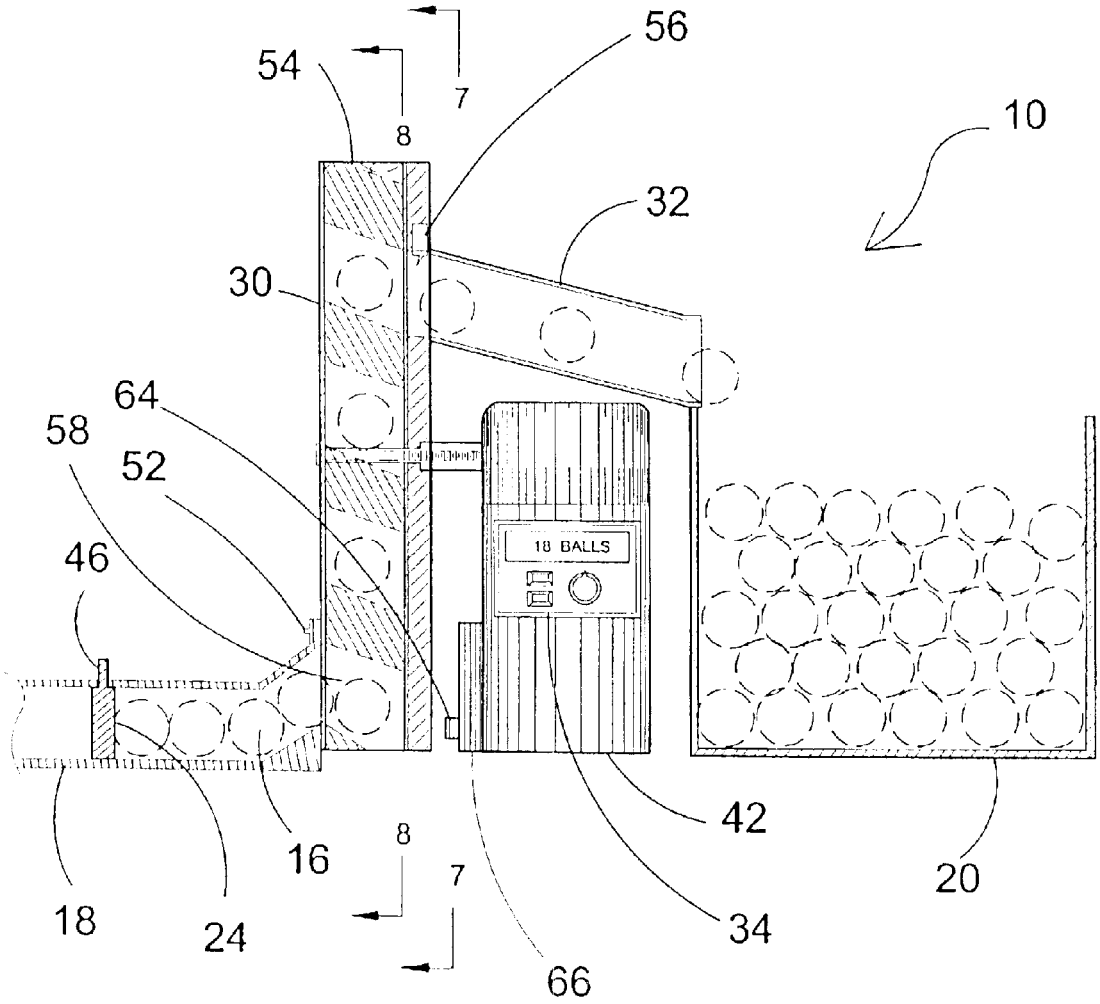
FIG. 5 is a sectional view of the present invention in use.

Turning to FIG. 5, shown therein is a sectional view of the present invention 10 in use. The paddle 24 moves from one distal end of the gutter 18 to the other driving the balls 16 to the cavities 58 within the conveyor wheel 54 which will transport them one at a time to the open end of a chute 32 for transfer to a ball hopper 20. When the guide 46 portion of the paddle 24 hits the guide paddle sensor 52, the paddle reverses its course until it is time to repeat its motion. Other elements previously disclosed are also shown.

Figure 6:
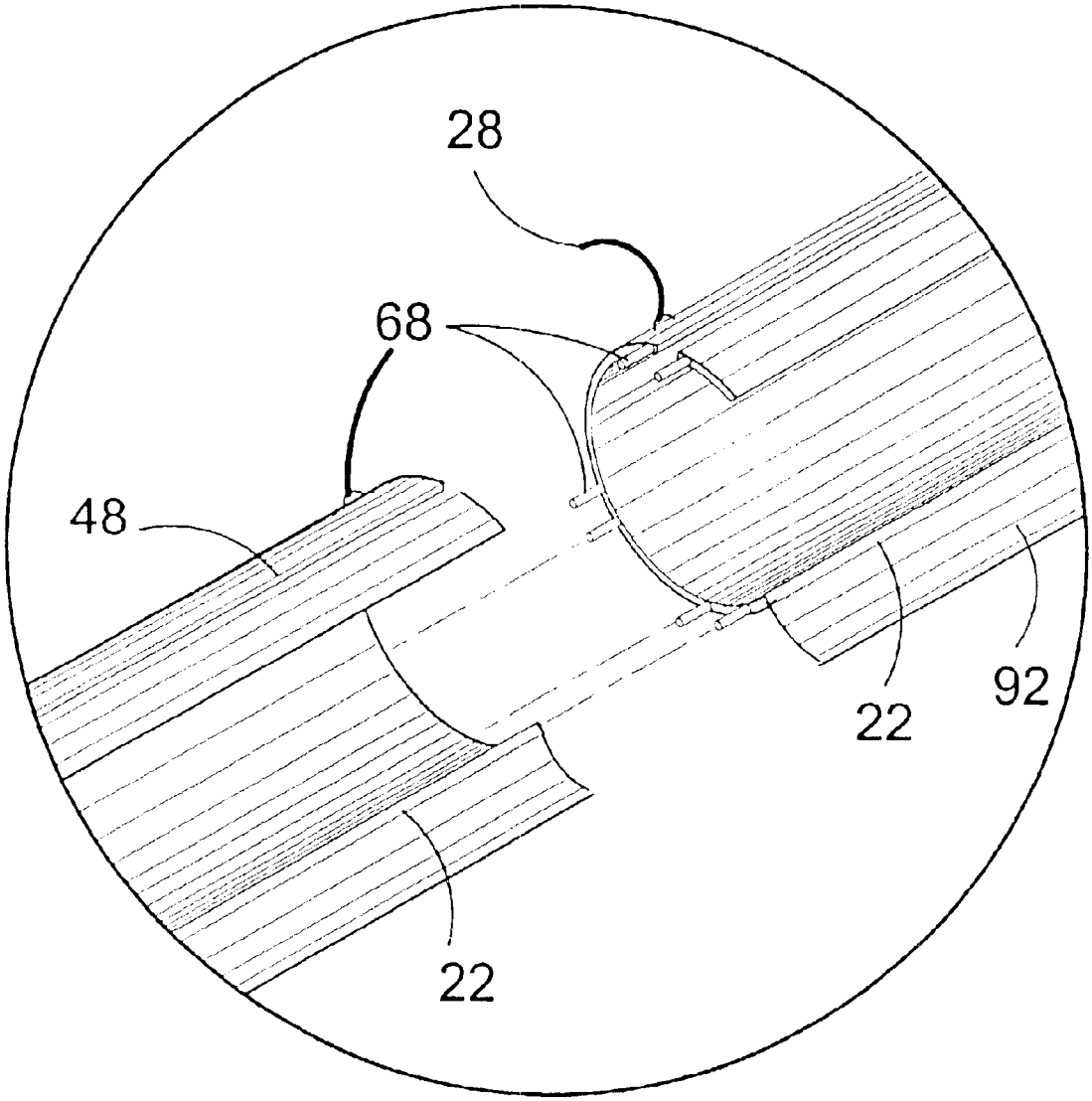
FIG. 6 is a detail view of the gutter connection of the present invention.

Turning to FIG. 6, shown therein is a detail view of the gutter connection of the present invention. The gutter portion, having a lip 92 for retaining the tennis balls therein, consists of three sections 22 connected to each other by pins 68. A strap 28 connects each section 22 and is used when the gutters are disassembled, folded and stored side by side conveniently. Track 48 is also shown.

Figure 7:
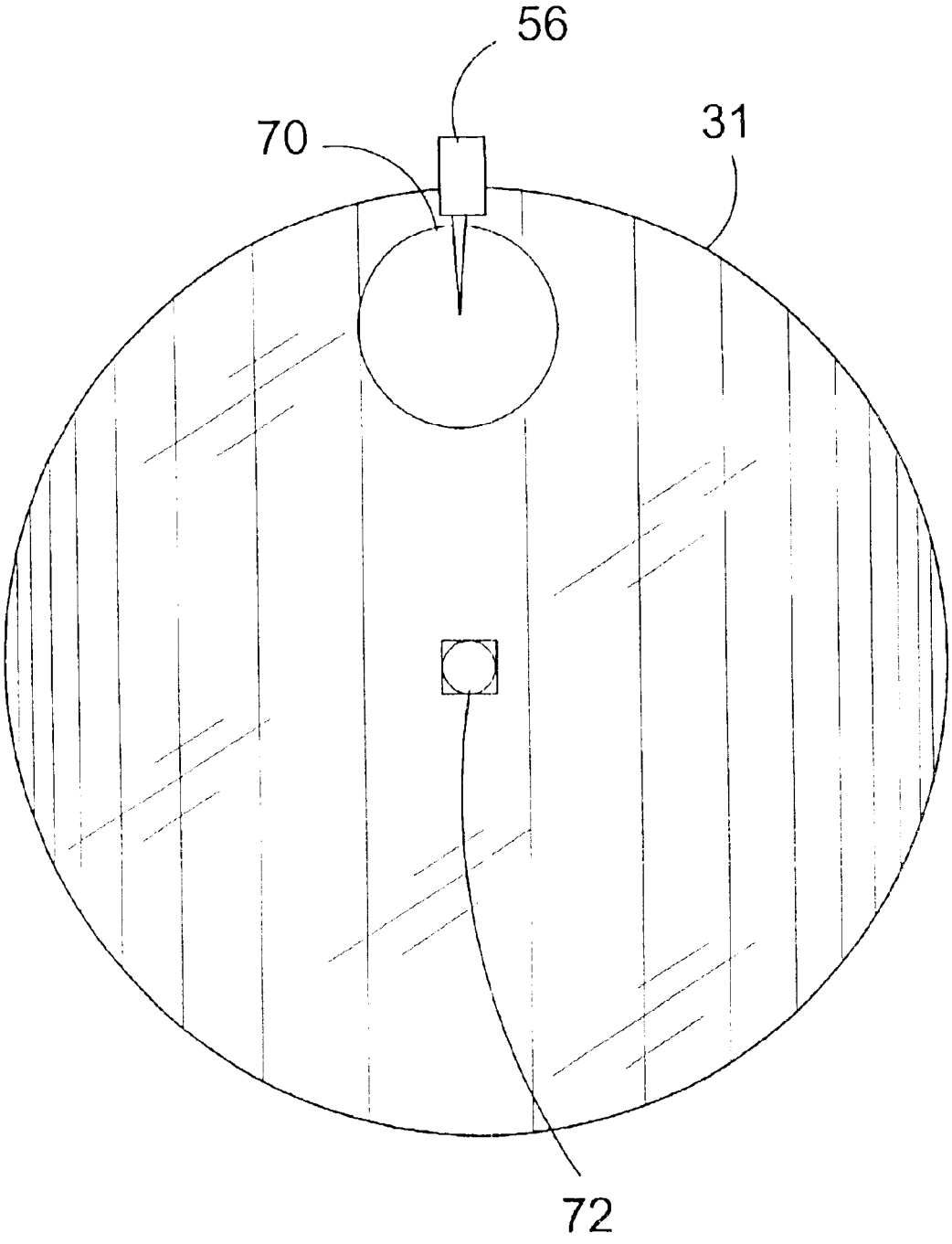
FIG. 7 is a frontal view of the stationary plate of the present invention.

Turning to FIG. 7, shown therein is a frontal view of the rear stationary plate 31 of the present invention 10. The stationary plate 31 with center locking means 72 does not rotate with the wheel conveyor and remains in a stationary position as the conveyor rotates. Plate 31 prevents the tennis balls from falling out the back end of the conveyor wheel until the wheel brings the ball to an opening 70 within the stationary plate 31 where the ball is free to fall into the ball hopper chute. A digital sensor 56 counts the balls as they pass through the opening.

Figure 8:
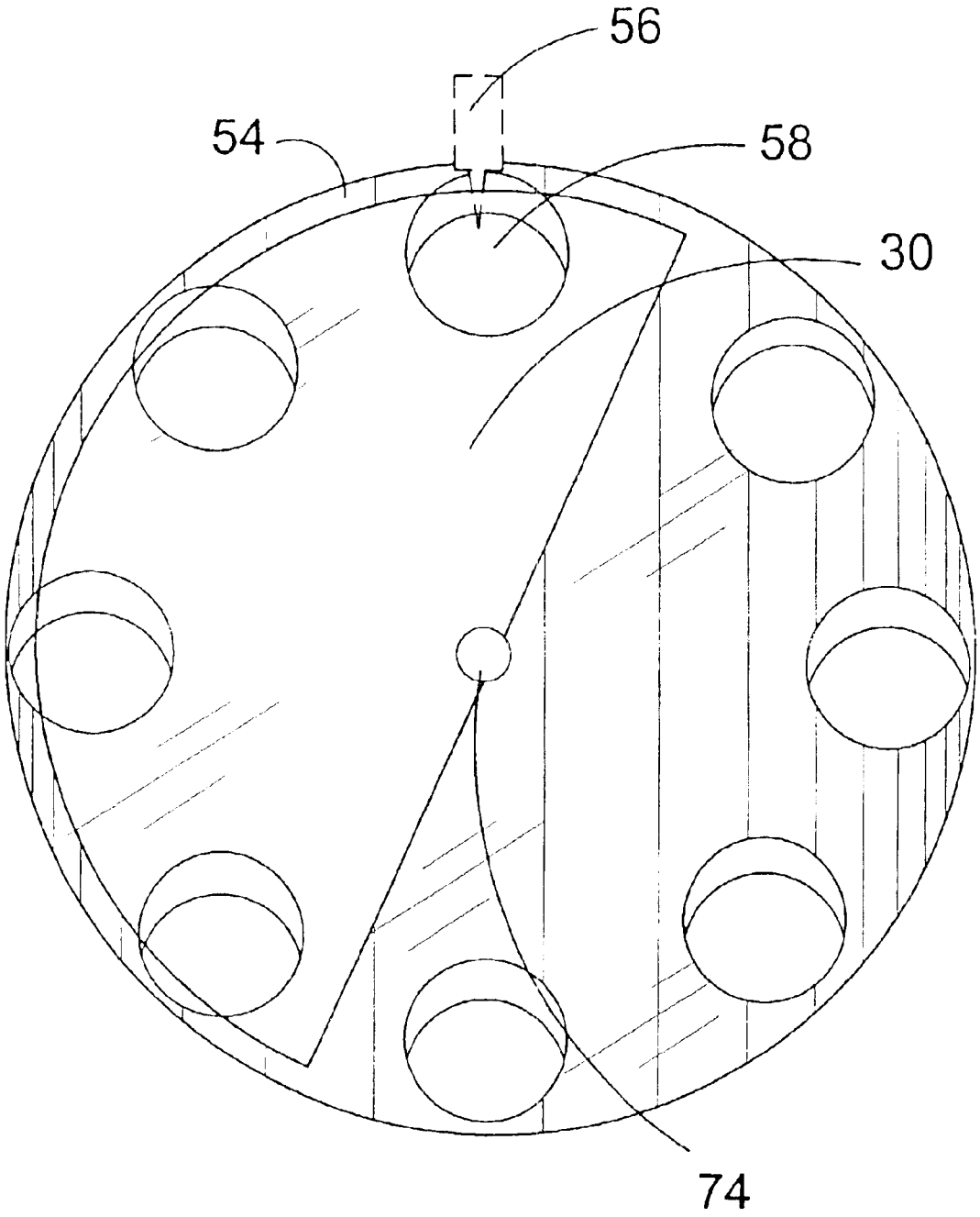
FIG. 8 is a frontal view of the conveyor wheel of the present invention.

Turning to FIG. 8, shown therein is a frontal view of the conveyor wheel 54 of the present invention showing the tennis ball pockets or cavities 58 into which the tennis balls are loaded. Also shown are the front stationary plate 30, digital sensor 56 and threaded shaft hole 74 whereby the wheel 54 rotates.

Figure 9:
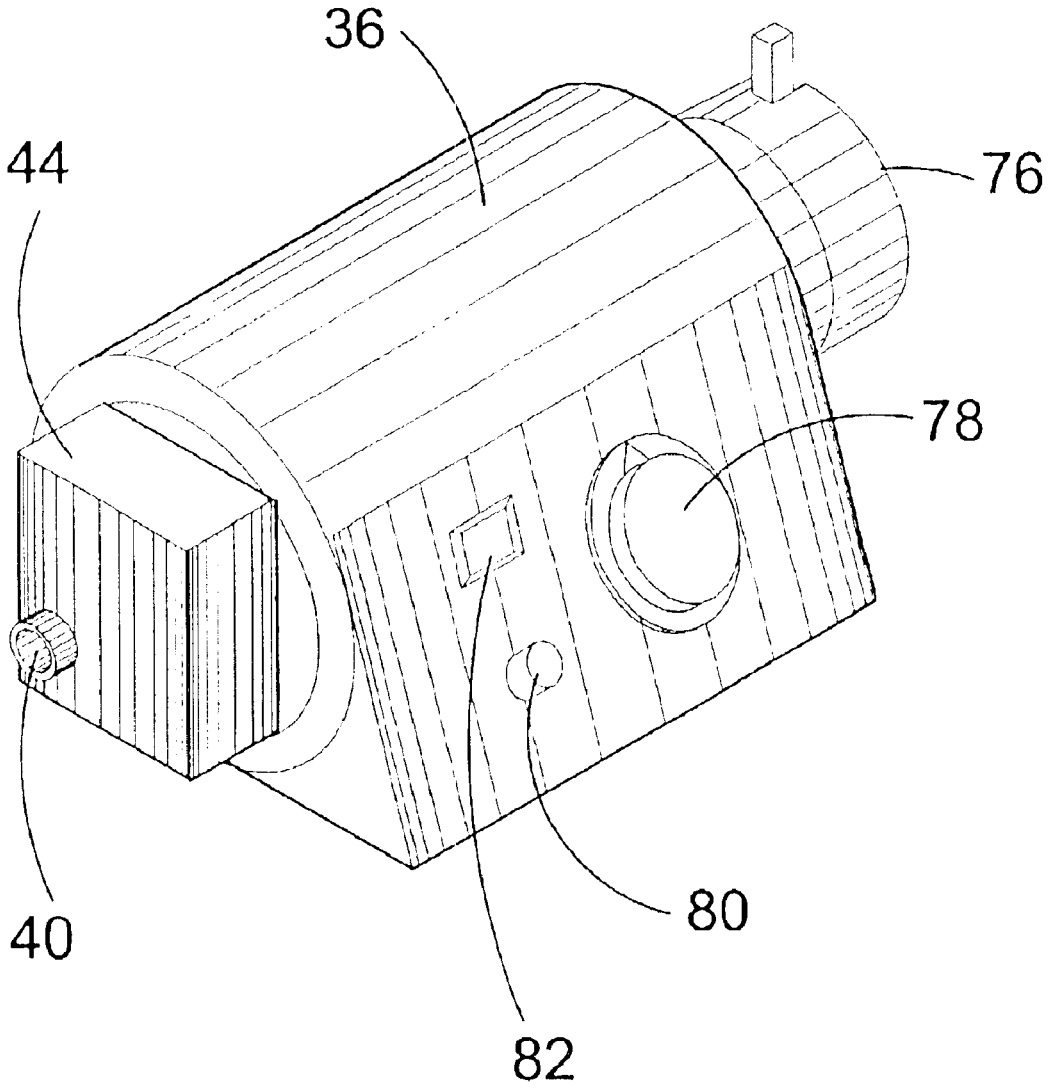
FIG. 9 is a detail perspective view of the paddle motor of the present invention.

Turning to FIG. 9, shown therein is a detail perspective view of the paddle motor control 36 of the present invention. Shown above is a detail view of the paddle motor control 36 consisting of a control panel and power pack 44 with AC/DC adapter 40. Also shown is the electrical track adapter 76, a timer 78, AC/DC switch 80, and power on/off switch 82.

Figure 10:
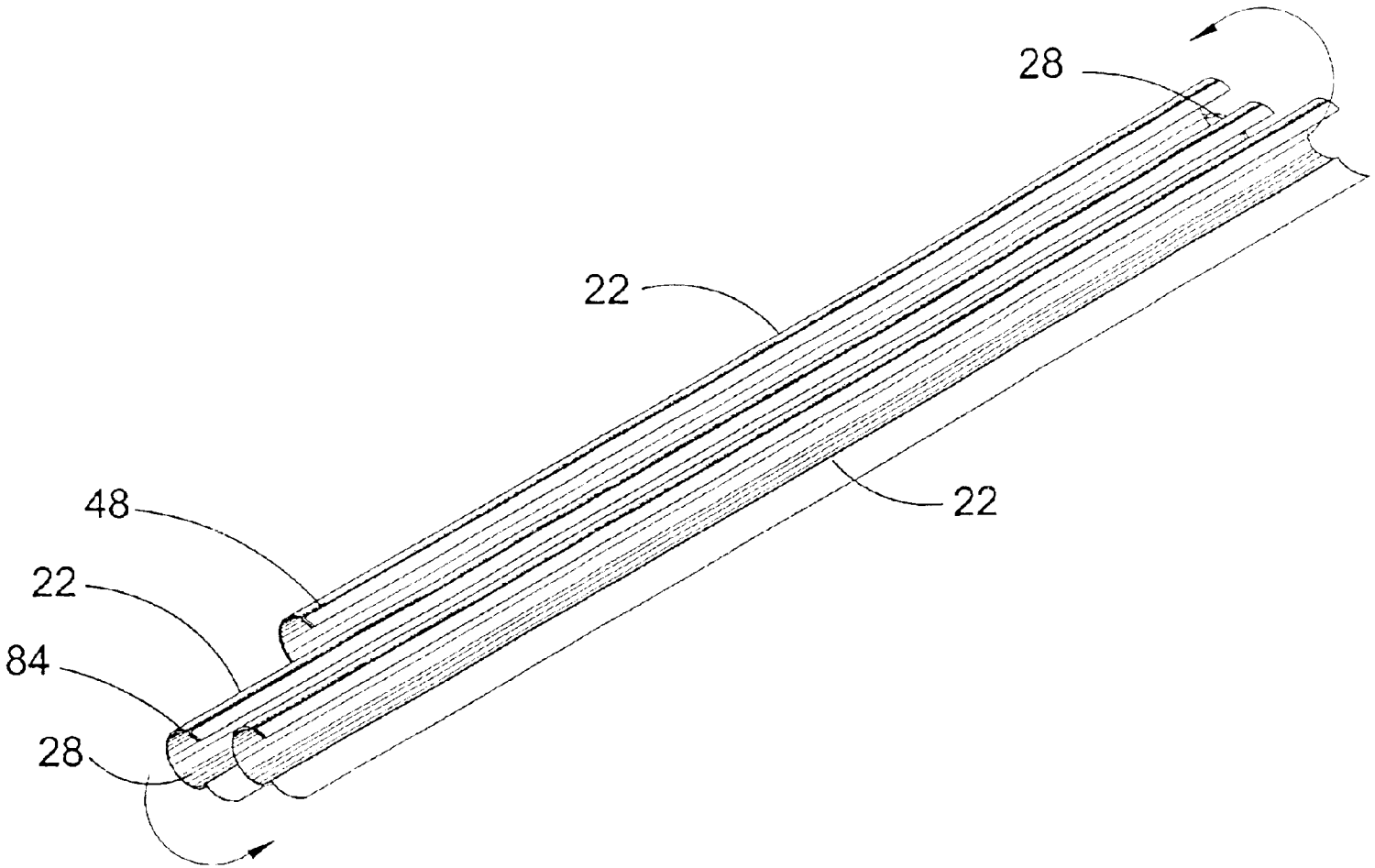
FIG. 10 is a perspective view of the three-piece gutter assembly in a folded position of the present invention.

Turning to FIG. 10, shown therein is a perspective view of the three-piece gutter 22 assembly in a folded position of the present invention. Elastic shock cords 28 are attached to the end portions of the gutter pieces 22 and allow for the unplugging of the gutter pieces so that they remain connected to each other and allow for the folding of each portion of the gutter for storage. The track 48 and track support ring 84 is also shown.

Figure 11:
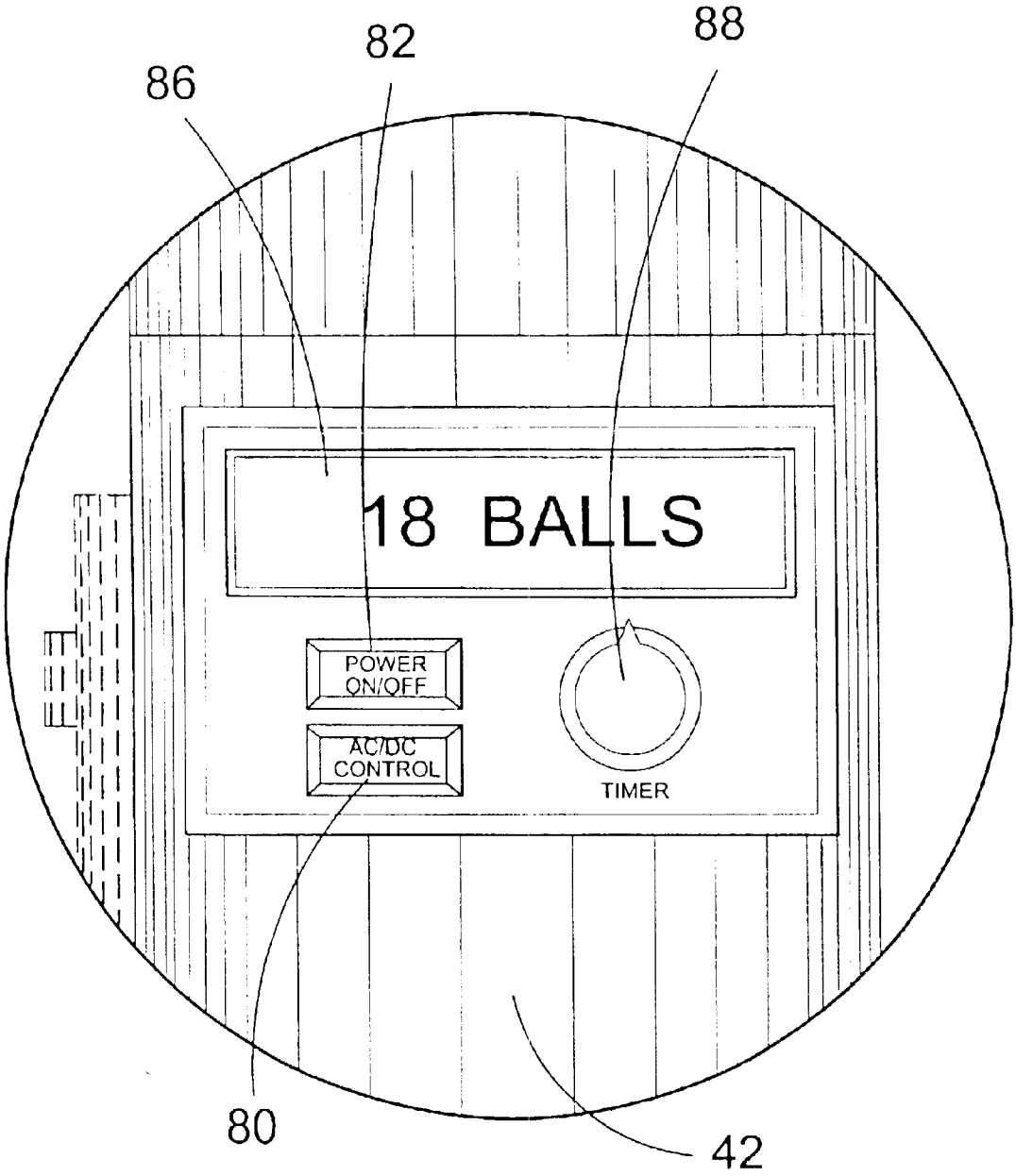
FIG. 11 is a frontal view of the digital counter control panel of the present invention.

Turning to FIG. 11, shown therein is a frontal view of the digital counter control panel of the present invention. A counter sensor located above the ball opening of the stationary plate sends signals to the counter and displays the count on a digital display 86. An AC/DC adapter is divided as means of power source. Also shown are the conveyor motor 42, AC/DC switch 80, power on/off switch 82, and timer set knob 88.

Figure 12:
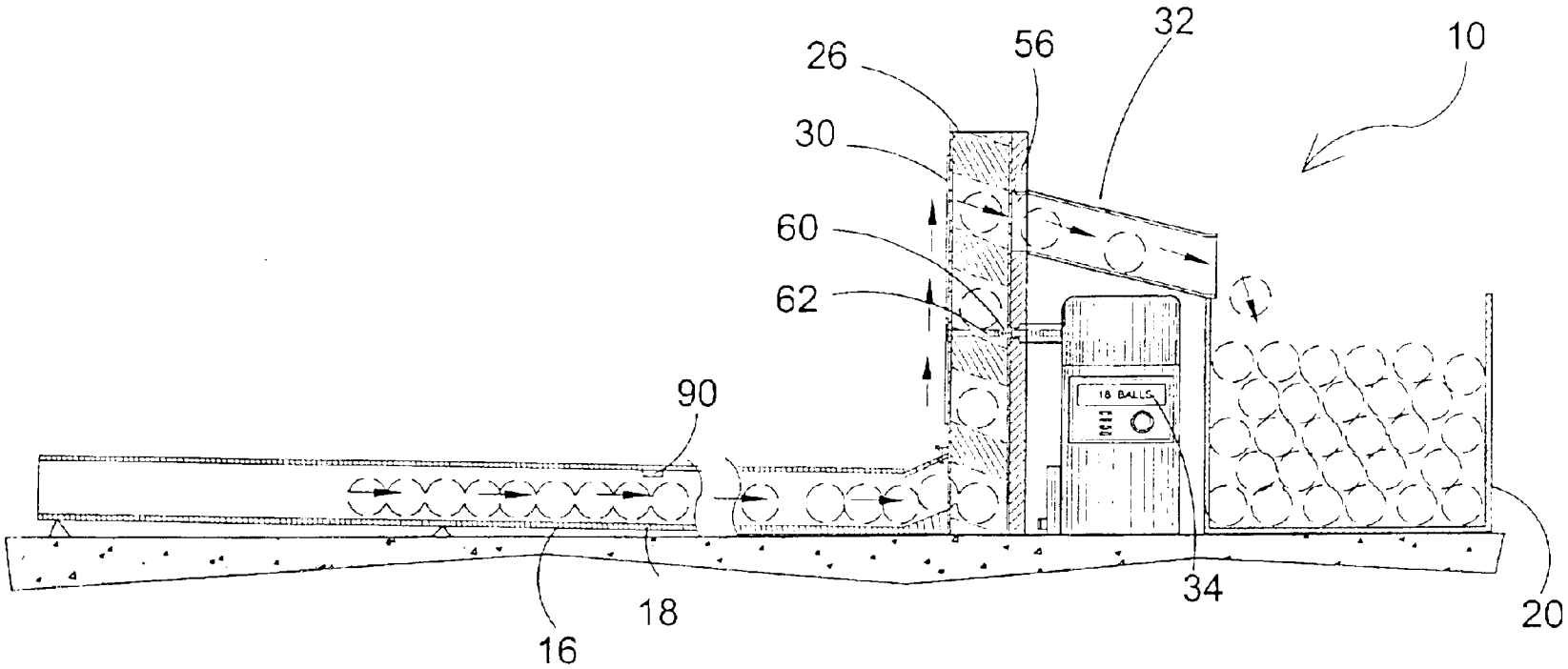
FIG. 12 is a sectional view of the present invention.

Turning to FIG. 12, shown therein is an alternative embodiment of the present invention 10 similar to FIG. 4. In this embodiment the balls 16 roll by force into the gutter 18 and are gravity fed downwardly toward the conveyor system 26 end where a selectively positioned sensor 90 activates the ball conveyor system 26 upon accumulation of a predetermined number of balls 16 in the gutter 18. Other elements of this embodiment are similar to those previously described. Other elements previously disclosed are also shown.

What is claimed to be new and desired to be protected by Letters patent is set forth in the appended claims.

1. An apparatus for collecting, counting and storing tennis balls for use in conjunction with a tennis court, comprising:

a) means for a gutter disposed across the end of the tennis court whereby the balls are collected therein, said means for a gutter having a first and a second end;

b) means for moving balls through said means for a gutter whereby the balls are moved from said first end to said second end of said means for a gutter;

c) a ball hopper disposed on said second end of said means for a gutter;

d) means for a ball conveyor system disposed on said second end of said means for a gutter whereby the balls are conveyed from said means for a gutter to a means for a chute; and, e) means for a chute whereby balls are conveyed by gravity to said ball hopper from said means for a ball conveyor system, wherein said means for a gutter comprises:

1) a plurality of sections of gutter;

2) means for joining said sections together;

3) a plurality of elastic cords joining the ends of said sections together to permit the sections to be stored;

4) a track to assist in operating said means for moving balls through said gutter, said track being longitudinally disposed along said gutter; and, 5) a lip disposed on said gutter to permit the balls to be retained in said gutter.

2. The apparatus of claim 1, wherein said means for joining said sections together further comprise said gutter section ends having a plurality of holes therein, further said gutter section ends having a plurality of pins disposed thereon, said holes for receiving said pins to permit said sections to be joined together.

3. The apparatus of claim 2, wherein said means for moving balls through said means for a gutter comprises:

a) a paddle disposed in said gutter wherein said paddle pushes the balls through said gutter, said paddle having a paddle guide thereon which guide moves within said track of said gutter;

b) a linear motor disposed within said gutter to permit said paddle to be moved along said gutter; and, c) a control for said linear motor to permit the controlled operation of said linear motor.

4. The apparatus of claim 3, wherein said control for said linear motor further comprises a track adapter to permit connection to said track, a battery power supply, an AC/DC adapter to permit an AC power supply, a timer to permit selective operation of said linear motor, and a power on/off switch to permit control of said linear motor.

5. The apparatus of claim 4, wherein said means for a ball conveyor system comprises:

a) a conveyor wheel, said conveyor wheel having a plurality of cavities therein, said cavities each for receiving a tennis ball, said wheel having a front and rear side;

b) a conveyor motor for rotating said conveyor wheel;

c) a control for said conveyor motor;

d) means for a front stationary plate disposed on said front of said conveyor wheel whereby balls are maintained within the ball cavities as the ball cavities are rotated toward the means for a chute; and, e) means for a rear stationary plate disposed on said rear of said conveyor wheel whereby balls are maintained within the ball cavities as the cavities are rotated toward the means for a chute.

6. The apparatus of claim 5, wherein said conveyor wheel is generally upright standing, wherein said wheel turns clockwise, wherein said wheel rotates in a vertical plane perpendicular to the axis of said gutter, wherein said wheel turns about a central shaft disposed therein, said shaft being connected to said conveyor motor.

7. The apparatus of claim 6, wherein said means for a front stationary plate comprises a front plate which covers about one-half of the face of said conveyor wheel.

8. The apparatus of claim 7, wherein said means for a rear stationary plate comprises a rear plate having a hole therein.

9. The apparatus of claim 8, wherein said control for said conveyor motor further comprises a digital display to permit an indication of the number of balls conveyed, a battery power supply, an AC/DC adapter to permit an AC power supply, an AC/DC switch to permit a selection of either a battery or AC power supply, a timer to permit selective operation of said conveyor motor, and a power on/off switch to permit control of said conveyor motor.

10. The apparatus of claim 9, wherein said means for a chute comprises a chute extending from said hole in said rear stationary plate to said ball hopper to permit a tennis ball to pass therethrough.

11. The apparatus of claim 10, further comprising a paddle guide sensor disposed on said second end of said gutter to permit the paddle to be sensed and reversed back to the first end of the gutter in order to repeat the operation of the paddle.

12. The apparatus of claim 11, further comprising a ball sensor disposed in the hole of said rear stationary plate to permit the ball to be sensed and counted by the digital display on the conveyor motor.

13. The apparatus of claim 12, wherein said first end of said gutter is higher than said second end to permit gravity to move the tennis balls from said first end to said second end of said gutter.

* * * * *